US012246799B1

(12) United States Patent
Nolan

(10) Patent No.: US 12,246,799 B1
(45) Date of Patent: Mar. 11, 2025

(54) EXPANDABLE DRIFT SOCK SYSTEM

(71) Applicant: Lawrence Nolan, North Ridgeville, OH (US)

(72) Inventor: Lawrence Nolan, North Ridgeville, OH (US)

( * ) Notice: Subject to any disclaimer, the term of this patent is extended or adjusted under 35 U.S.C. 154(b) by 0 days.

(21) Appl. No.: 18/961,241

(22) Filed: Nov. 26, 2024

(51) Int. Cl.
*B63B 21/48* (2006.01)
*B63B 21/66* (2006.01)

(52) U.S. Cl.
CPC ..... *B63B 21/48* (2013.01); *B63B 21/66* (2013.01)

(58) Field of Classification Search
CPC ..... B63B 21/48; B63B 21/66; B64D 17/80
USPC ..... 114/311; 244/112, 113
See application file for complete search history.

(56) References Cited

U.S. PATENT DOCUMENTS 289,224 A * 11/1883 Clarke ..... B63B 21/48 114/311
2,536,681 A 1/1951 Finken et al.
2,761,636 A 9/1956 Finlay
3,316,670 A 5/1967 Johnson
3,417,725 A 12/1968 Fisher
4,481,900 A 11/1984 Kalinowski et al.
4,534,306 A 8/1985 Kalinowski et al.
4,632,051 A 12/1986 Raymond et al.
5,025,746 A 6/1991 Boulter
5,394,817 A 3/1995 Kaufman
5,463,971 A 11/1995 Abernethy et al.
5,501,451 A * 3/1996 Slusarczyk ..... A63B 21/0088 473/459
6,135,046 A 10/2000 Beech
6,550,413 B2 4/2003 Fiorentino et al.
7,207,287 B2 4/2007 Beech et al.
8,371,993 B2 2/2013 Brown et al.
9,050,489 B2 6/2015 Bell
2005/0178311 A1 8/2005 Wittig

FOREIGN PATENT DOCUMENTS

GB 1462155 A 1/1977
GB 2115362 A1 9/1983

* cited by examiner

*Primary Examiner* — Ajay Vasudeva
(74) *Attorney, Agent, or Firm* — Invention To Patent Services; Alex Hobson

(57) ABSTRACT

An expandable drift sock system includes an expandable drift sock having a plurality of expansion sections configured around the circumference of the cylindrical sleeve, each having a first and second expansion portion detachably attached to each other by a section coupler. The first and second expansion portions each have an outer extension and fold portion that folds back to join with an inner extension that extends between the fold portions of the first and second expansion portions. Flaps are configured to fold over each expansion portion to hold the expansion portion in a folded configuration and to prevent water from flowing in between the folds that may produce force the stowed expansion portion to open.

19 Claims, 3 Drawing Sheets

EXPANDABLE DRIFT SOCK SYSTEM

BACKGROUND OF THE INVENTION

Field of the Invention

The invention relates to an expandable drift sock system including an expandable drift sock having a plurality of expansion sections configured around the circumference of the cylindrical sleeve having a first and second expansion portion detachably attached to each other by a section coupler and flaps that fold over the configuration and prevent water from flowing between folds of the expansion portions.

Background

Drift socks are used to slow a boats rate of drift in current and may be used in recreational situations including during fishing. Some boaters carry a variety of drift socks that are different sizes depending on the current and how much they want to slow the boats drift in the current. This requires packing and storing a plurality of drift socks onboard which takes up valuable space on the boat.

SUMMARY OF THE INVENTION

The invention relates to an expandable drift sock system that includes an expandable drift sock having a plurality of expansion sections configured around the circumference of the cylindrical sleeve, each having a first and second expansion portion detachably attached to each other by a section coupler. The first and second expansion portions each have an outer extension and fold portion that folds back to join with an inner extension that extends between the fold portions of the first and second expansion portions. Flaps are configured to fold over each expansion portion to hold the expansion portion in a folded configuration and to prevent water from flowing in between the folds that may produce force the stowed expansion portion to open.

The invention relates to an expandable drift sock system including an expandable drift sock having a plurality of expansion sections configured around the circumference of the cylindrical sleeve having a first and second expansion portion detachably attached to each other by a section coupler and flaps that fold over the configuration and prevent water from flowing between folds of the expansion portions.

An expandable drift sock system comprises an expandable drift sock that includes a cylindrical sleeve with a plurality of expansion sections configured to move from a stowed configuration to an expanded configuration. The cylindrical sleeve has an outer perimeter and extends from an inlet end to an outlet end. The inlet end has an inlet opening for receiving a flow of water therein, and the outlet end has an outlet end opening for said flow of water to flow out from the cylindrical sleeve. The cylindrical sleeve may be a conical sleeve, conical in shape, wherein the inlet end or inlet end opening has a diameter that is larger than the outlet end or outlet end opening diameter of the outlet end. The ratio of the inlet diameter 24 to the outlet diameter may be 1.5:1 or more, about 2:1 or more, about 3:1 or more, about 5:1 or more in stowed configuration and the inlet end diameter may be expanded by expanding one or more of the expansion sections. The diameter ratio of the inlet diameter to the outlet diameter when in a fully expanded configuration with each of the plurality of expansion sections expanded may be about 1:5:1 or more, about 2:1 or more, about 3:1 or more, about 5:1 or more, about 8:1 or more, about 10:1 or more and any range between and including the ratios provided. Also, the expansion ratio of the inlet diameter in a stowed configuration to the inlet diameter when in a fully expanded configuration may be about 1.5:1 or more, about 2:1 or more, about 2.5:1 or more, about 3:1 or more, about 5:1 or more and any range between and including the ratios provided.

The expandable drift sock may have an inlet end or inlet end opening diameter that can changed from a stowed configuration to an expanded configuration by opening each of the plurality of expansion sections, wherein the inlet expansion ratio of the inlet diameter from a fully expanded configuration to a fully stowed configuration may be about 1.5:1 or more, about 2:1 or more, about 2.5:1 or more, about 3:1 or more. When the fold portions of the expansion portions is about the same length as the outer extension of said expansion portions then the inlet expansion ratio may be about 3:1. The increase in the inlet diameter may be increased or incrementally by opening one or a portion of the expansion sections as desired to provide the proper drift rate in a current.

An expandable drift sock may have a plurality of expansion sections, such as two or more, three or more, four or more, five or more, six or more or even about eight or more and any range between and including the number of expansion sections provided.

The cylindrical sleeve may be a conical sleeve that has a length of about 0.5 m or more, about 0.75 m or more, about 1 m or more, about 1.5 m or more, about 2 m or more, about 2.5 m or more and any range between and including the lengths provided. The diameter of the inlet end of the cylindrical sleeve in a fully stowed configuration may be about 0.5 m or more, about 0.75 m or more, about 1.0 m or more, about 1.25 m or more, about 1.5 m or more, about 2.0 m or more, about 2.5 m or more and any range between and including the values provided. The fully expanded diameter of the inlet end may be any of the ratios provided herein. The length and diameter of the cylindrical sleeve may be chosen based on the size of the boat and the speed of the current.

Each expansion section has a first expansion portion and a second expansion portion having a first fold portion and second fold portion, respectively, that extends from a respective first outer extension and second outer extension to an inner extension. An expansion section can be changed from a stowed configuration with the section coupler coupling the first expansion portion to the second expansion portion with the first coupler component attached to the second coupler component. The section coupler may be a zipper, having a coupler interface or slider having a pull tab to move the slider along zipper teeth, wherein a first series of zipper teeth extend along the first expansion portion and a second series of zipper teeth extend along the second expansion portion. A zipper may be a more durable and secure means of retaining the first expansion portion to the second expansion portion, more secure than buttons, snaps or hook-and-loop fasteners.

The section coupler or zipper may extend from the inlet end along the length of the cylindrical sleeve toward the outlet end. A cuff may be configured around the outlet end and the section coupler may terminate at or proximal to this cuff. The section coupler may extend a percentage of the length of the cylindrical sleeve, such as at least 50% or more, about 75% or more, about 85% or more, about 90% or more or any range between and including the values provided.

A section coupler is configured to detachably attach the first expansion portion to the second expansion portion and may include a coupler interface that may be used to detach a first coupler component 56 to a second coupler component. The coupler interface may be a zipper slider and each of the first and second coupler components may form a zipper that can be unzipped from the inlet end down towards the outlet end of the cylindrical sleeve.

A section divider may extend between each expansion section and may be a reinforced divider having a cuff, or strip of reinforcing material, such as a fabric, extending between a first expansion section and a second expansion section. The drag straps may extend from one or more of the section dividers. A strap extends from a connected end to an extended end and an extended end coupler may couple together two or more of the straps.

Each expansion section has a first expansion portion and a second expansion portion. The first expansion portion includes an outer extension and a first fold portion that folds back on the outer extension, along the interior with respect to the outer extension. The first fold portion extends from the outer extension inward and circumferentially back toward the section divider. A seam or extension fold edge extends between the outer extension and the first fold portion. The first fold portion and outer extension may be a contiguous piece of material or fabric with the extension fold edge between these two edges. A first coupler component may extend from this extension fold edge and may be coupled to a tab to aid in coupling the first coupler component with the second coupler component. The first fold portion extends from the outer extension to the inner extension and may be folded along a first fold edge between the first fold portion and the inner extension. The first fold portion may extend inside of the outer extension, with respect to the outside surface of the cylindrical sleeve. The inner extension extends from the first fold portion to the second fold portion of the second expansion portion and again, a second fold edge may extend between the second fold portion and the inner extension. The inner extension extends from the first fold edge, or from the first fold portion to the second fold portion, and extends across the section coupler. The first fold portion and second fold portion may be a single continuous piece of material or fabric with folds between the outer extensions, and the respective fold portion and the inner extension.

The second expansion portion includes an outer extension and a second fold portion that folds back on the outer extension of the second expansion portion. The second fold portion extends from the outer extension circumferentially back toward the section divider, in an opposite circumferential direction from the first fold portion. A seam or extension fold edge extends between the outer extension and the second fold portion. A second coupler component may extend from this extension fold edge and may be coupled to a tab to aid in coupling the first coupler component with the second coupler component. The second fold portion extends from the outer extension to the inner extension and may be folded along a second fold edge between the second fold portion and the inner extension. The second fold portion may extend inside of the outer extension, with respect to the outside surface of the cylindrical sleeve.

The first and second fold portions may have a length from the inner extension to the outer extension that is a portion of the length of the respective outer extension they are coupled to and may extend a substantial portion of the length of the outer extension, which is from the extension fold edge to the section divider, such as at least 50% or this length, or about 75% of the outer extension length or more, about 90% of the outer extension length or more and any range between and including the values provided. The inner extension will have a length from the first fold edge to the second fold edge that is about the sum of the length of the first fold portion and second fold portion. When the first and second fold portions are about the length of the respective outer extensions, the length of the expansion section from the section dividers may be about tripled when the expansion section is converted from a stowed configuration to an expanded configuration. The length increase of the expansion section will be the sum of the length of each of the first and second fold portions and the length of the inner extension, about a cross-section of the cylindrical sleeve.

The fold portions and the inner extension may be retained or held in a stowed or folded configuration by flaps, wherein a flap extends from the outer extension and is detachably attached to an inner extension attachment component. The flap also has an attachment component for detachably attaching to the inner extension attachment component. The expansion sections each have a first expansion portion and second expansion portion that may be held down by the first and second flaps, respectively. A first flap and second flap are configured to extend from the outer extension and over the first expansion portion and second expansion portion, respectively. The first flap is detachably attached by a first flap attachment component, configured on an inside surface of the first flap, to the first inner extension attachment component. Likewise, the second flap is detachably attached by a second flap attachment component, to the second inner extension attachment component. The first flap attachment component may be detachably attached to an outer extension attachment component, such as an outer extension second attachment component. The outer extension may also have an outer extension first attachment component configured for detachable attachment to a folded portion attachment component.

The configuration of attachment components described herein, enables a flap to be attached to the inner extension attachment component and also the fold portion attachment component attached to an outer extension attachment component to very securely retain the expansion portion in a stowed and folded configuration with two points of retention or attachment. The section coupler provides a third type of attachment of the first expansion portion to the second expansion portion. The flap may then be detached from the inner extension attachment component and the fold portion can be detached from the outer extension attachment component to enable the expansion portion to unfold and expand with the section coupler configured in a detached configuration with the first coupler component detached from the second coupler component. Also, the flap may be attached to the interior surface of the outer extension with the flap attachment component detachably attached to the outer extension attachment component. This will hold the flap out of the way for the expansion portion to expand. The first and second inner extension attachment components may be a single attachment component that extends across the inner extension, wherein a first portion on a first end is configured for the first flap to detachably attach to and a second portion on the opposing end is configured for the second flap to detachably attach to.

The second expansion portion has the second flap detachably attached via the second flap attachment component attached to the outer extension second attachment component or the outer extension of the second expansion portion. The flaps may extend over the inlet end of the expansion sections or expansion portions of an expansion section prevent water from flowing between the folds or layers of the expansion portion when in a stowed configuration and this reduces stress on the expansion portion and more effectively keeps the expansion portions stowed during use.

The attachment components described herein may be snaps, buttons and preferably are hook-and-loop fastener components, one of a hook component and a loop component of the hook-and-loop fastener. The hook-and-loop attachment enables quick attachment by simple pressing the two components together and detachment by pulling or peeling the two attached portions apart.

The expandable drift sock includes a cylindrical sleeve that is a flexible sleeve that may be made out of a fabric, such as a woven fabric. The fabric may be coated with a polymer such as a urethane coating. The expansion sections may be joined together by a section divider which may be strap, a reinforcing strap and the drag straps may be coupled to the section dividers.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
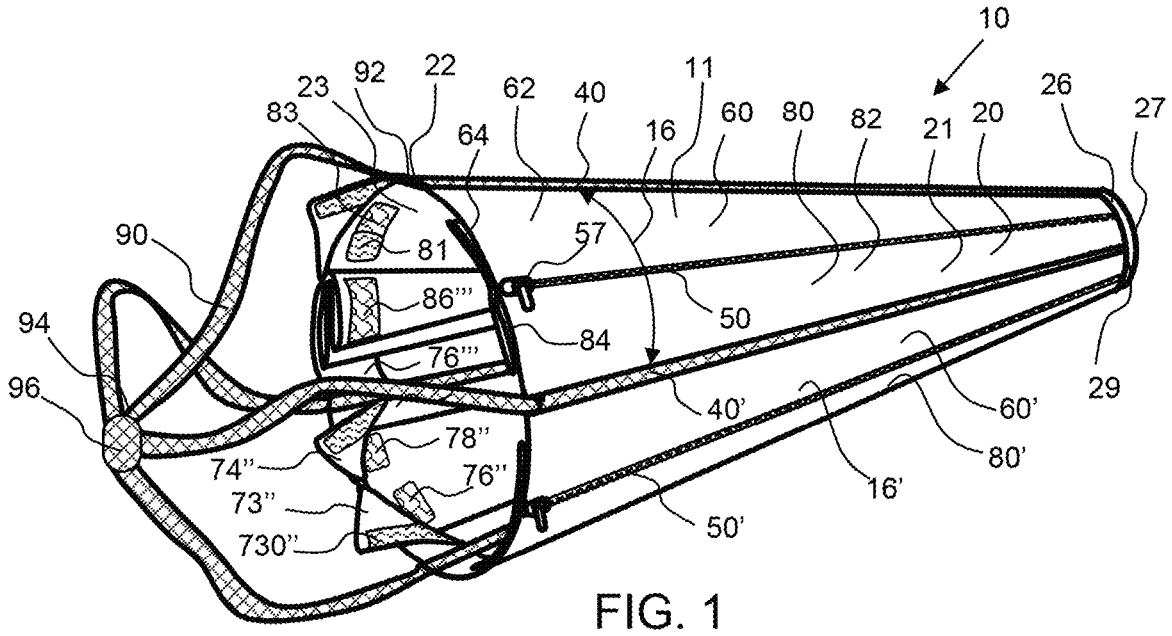
FIG. 1 shows a perspective view of an expandable drift sock system comprising a cylindrical sleeve with a plurality of expansion sections, each with a first expansion portion and second expansion portion that are detachably attached to each other by section coupler.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be an included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
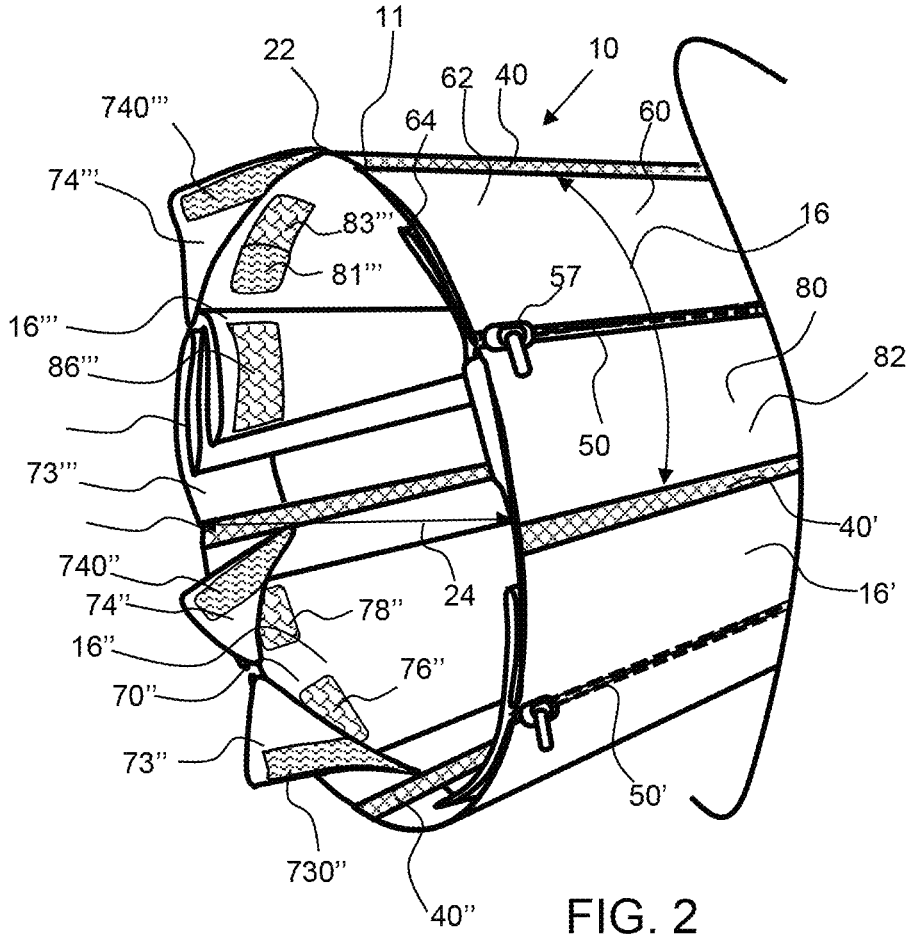
FIG. 2 shows an enlarged perspective view of the inlet end of the expandable drift sock system shown in FIG. 1, with the straps not shown for ease of illustration, comprising a flap that are configured to extend over and retain a respective expansion portion in a stowed configuration, folded and held down by the flap with the folded portion retained to the outer extension.
Figure 3:
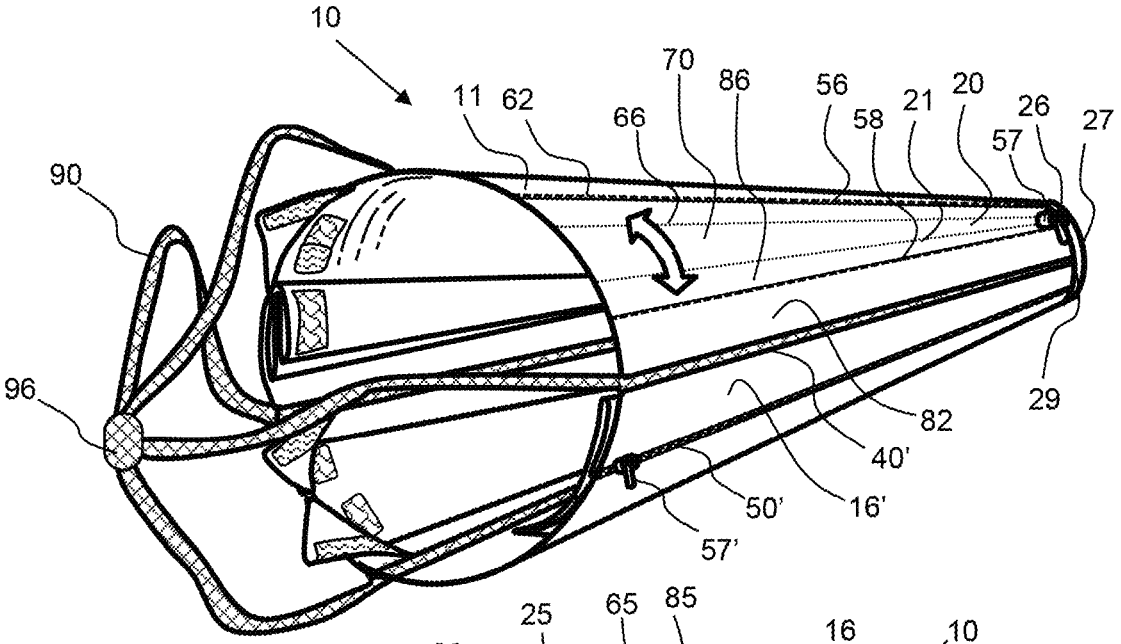
FIG. 3 shows a perspective view of the expandable drift sock system shown in FIG. 1, with the first expansion section now in an expanded configuration with the section coupler opened and the folded portions unfolded to extend the inner extension to form a portion of the outer perimeter of the cylindrical sleeve.

Referring now to FIGS. 1 to 5, an expandable drift sock system 10 comprises an expandable drift sock 11 that includes a cylindrical sleeve 20 with a plurality of expansion sections 16 configured to move from a stowed configuration, shown in FIGS. 1 and 2, to an expanded configuration shown in FIG. 3. As shown in FIG. 1, the cylindrical sleeve has an outer perimeter 21 and extends from an inlet end 22 to an outlet end 26. The inlet end 22 has an inlet opening 23 for receiving a flow of water therein, and the outlet end 26 has an outlet end opening 27 for said flow of water to flow out from the cylindrical sleeve. The cylindrical sleeve may be conical in shape, wherein the inlet diameter 24 is larger than the outlet diameter or diameter of the outlet end 26. The ratio of the inlet diameter 24 to the outlet diameter may be 1.5:1 or more, about 2:1 or more, about 3:1 or more, about 5:1 or more in stowed configuration and the inlet end diameter may be expanded by expanding one or more of the expansion sections. The diameter ratio of the inlet diameter to the outlet diameter when in a fully expanded configuration with each of the plurality of expansion sections expanded may be about 2:1 or more, about 3:1 or more, about 5:1 or more, about 8:1 or more, about 10:1 or more and any range between and including the ratios provided. Also, the expansion ratio of the inlet diameter in a stowed configuration to the inlet diameter when in a fully expanded configuration may be about 1.5:1 or more, about 2:1 or more, about 2.5:1 or more, about 3:1 or more, about 5:1 or more and any range between and including the ratios provided.

The inlet end 22 has an inlet diameter 24, shown in FIG. 2, that is expandable, by expanding one or more of the expansion sections 16, 16', 16" and 16'". Each expansion section has a first expansion portion 60 and a second expansion portion 80 having a first fold portion and second fold portion, respectively, that extends from a respective first outer extension 62 and second outer extension 82 to an inner extension 70.

An outlet end cuff 29 may extend around the outlet end 26 and may secure the expansion sections together and strengthen the cylindrical sleeve circumferentially as the reduced diameter of the outlet end will restrict the water flow and produce radial force on the cylindrical sleeve.

As shown in FIG. 3, expansion section 16 is in an expanded configuration with the first coupler component 56 detached from the second coupler component 58; wherein the coupler interface is slid down to the outlet end 26 of the cylindrical sleeve to unzip or detach the first expansion portion 60 from the second expansion portion 80. The inlet diameter is larger in FIG. 3 than in FIG. 1 as a result of the first expansion section being in an expanded configuration.

A section coupler 50 is configured to detachably attach the first expansion portion 60 to the second expansion portion and may include a coupler interface 57 that may be used to detach a first coupler component 56 to a second coupler component 58. The coupler interface may be a zipper slider and each of the first and second coupler components may form a zipper that can be unzipped from the inlet end down towards the outlet end of the cylindrical sleeve.

A section divider 40 may extend between each expansion section and may be a reinforced divider having a cuff 42, or strip of reinforcing material, such as a fabric, extending between a first expansion section and a second expansion section. The drag straps 90 may extend from one or more of the section dividers as shown in FIG. 1. A drag strap 90 extends from a connected end 92 to an extended end 94 and an extended end coupler 96 may couple together two or more of the straps, as shown.

Figure 4:
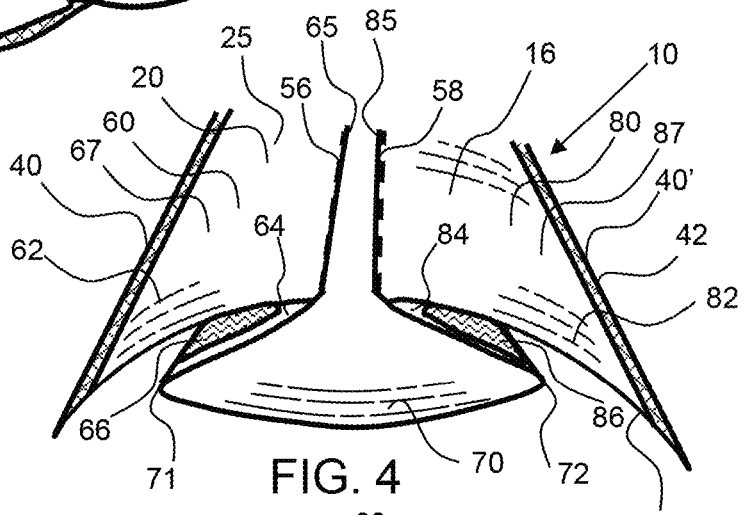
FIG. 4 shows a perspective outside view of an expansion section with the section coupler detached and the first and second folded portion of the respective first and second expansion section folding to move the inner extension out to form a portion of the outer perimeter of the cylindrical sleeve.
Figure 5:
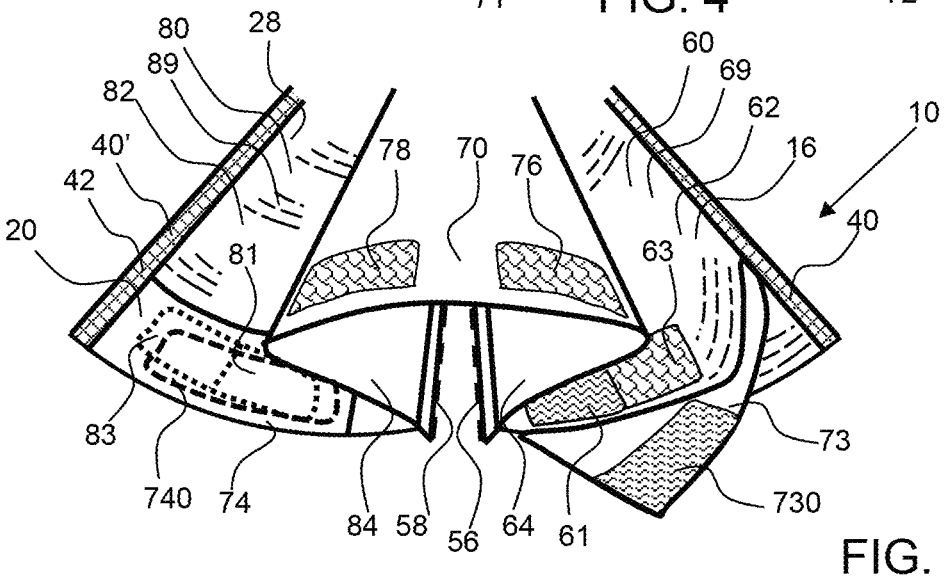
FIG. 5 shows a perspective inside view of the expansion section shown in FIG. 4 with the section coupler detached and the first and second folded portion of the respective first and second expansion section folding to move the inner extension out to form a portion of the outer perimeter of the cylindrical sleeve.

With reference to FIGS. 4 and 5, each expansion section 16 has a first expansion portion 60 and a second expansion portion 80. The first expansion portion 60 includes a first outer extension 62 and a first fold portion 64 that folds back on the outer extension, along the interior, or radially inward from the inside surface 28 (shown in FIG. 4) of the cylindrical sleeve 20 or the first outer extension 62. The first fold portion 64 extends from the outer extension 62 circumferentially back toward the section divider 40. A seam or extension fold edge 65 extends between the first outer extension 62 and the first fold portion 64. A first coupler component 56 may extend from this extension fold edge 65 and may be coupled to a tab to aid in coupling the first coupler component 56 with the second coupler component 58. The first fold portion extends from the first outer extension 62 to the inner extension 70 and may be folded along a first fold edge 71 between the first fold portion 64 and the inner extension 70. The first fold portion 64 may extend inside of the first outer extension 62, with respect to the outside surface 25 of the cylindrical sleeve. The inner extension 70 extends from the first fold portion 64 to the second fold portion 84 of the second expansion portion and again, a second fold edge 72 may extend between the second fold portion 84 and the inner extension 70. The inner extension 70 extends from the first fold edge 71 or from the first fold portion 64 to the second fold portion 84 and extends across the section coupler 50. The first outer extension 62 has an outside surface 67 that forms a portion of the outside surface of the cylindrical sleeve and the second outer extension 82 has an outside surface 87 that forms a portion of the outside surface of the cylindrical sleeve. The inside surfaces 69, 89 of the first outer extension 62 and second outer extension 82 of the first expansion portion 60 and second expansion portion 80, respectively (FIG. 5), have a flap attachment component.

The second expansion portion 80 includes a second outer extension 82 and a second fold portion 84 that folds back on the second outer extension 82. The second fold portion 84 extends from the second outer extension 82 circumferentially back toward the section divider 40', in an opposite circumferential direction from the first fold portion 64. A seam or extension fold edge 85 extends between the second outer extension 82 and the second fold portion 84. A second coupler component 58 may extend from this extension fold edge 85 and may be coupled to a tab to aid in coupling the first coupler component 56 with the second coupler component 58. The second fold portion extends from the second outer extension 82 to the inner extension 70 and may be folded along a second fold edge 72 between the second fold portion 84 and the inner extension 70. The second fold portion 84 may extend inside of the second outer extension 82, with respect to the outside surface 25 of the cylindrical sleeve.

The first and second fold portion may have a length that is a portion of the length of the respective outer extension they are coupled to and may extend a substantial portion of the length of the outer extension, which is from the extension fold edge to the section divider, or at least 50% or this length, or about 75% of the outer extension length or more, about 90% of the outer extension length or more and any range between and including the values provided. The inner extension will have a length from the first fold edge 71 to the second fold edge 72 that is about the sum of the length of the first fold portion and second fold portion. When the first and second fold portions are about the length of the respective outer extensions, the length of the expansion section from the section dividers 40, 40' may be about tripled when the expansion section is converted from a stowed configuration to an expanded configuration. The length increase of the expansion section will be the sum of the length of each of the first and second fold portions and the length of the inner extension about a cross-section of the cylindrical sleeve.

The fold portions and the inner extension may be retained or held in a stowed or folded configuration by flaps, wherein the flap extends from the outer extension and is detachably attached to an inner extension attachment component. The flap also has an attachment component for detachably attaching to the inner extension attachment component.

Figure 6:
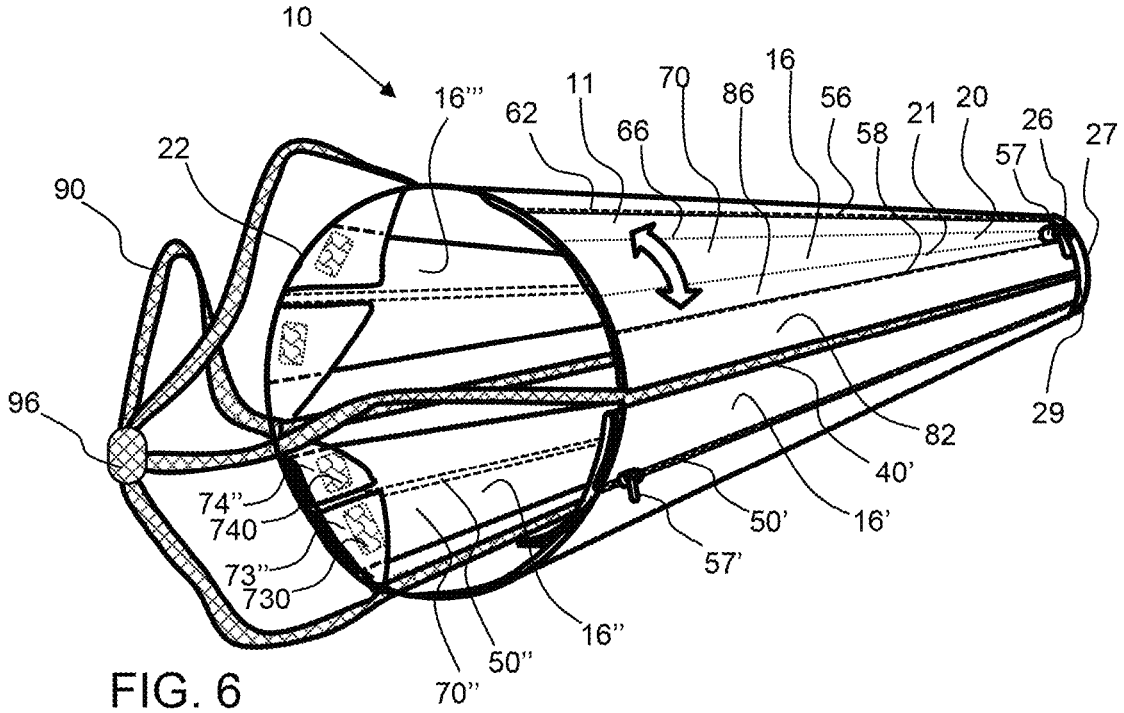
FIG. 6 shows a perspective view of the expandable drift sock system shown in FIG. 1, with the flaps extending over the expansion portions of two of the expansion sections to retain these sections in a stowed configuration.

As shown in FIG. 6, the expansion sections 16" and 16'" each have the first expansion portion and second expansion portion held down by the first and second flaps, respectively. In particular, expansion section 16" has a first flap 73" and second flap 74" extending from the outer extension and over the first expansion portion 60" and second expansion portion 80", respectively. The first flap 73" is detachably attached by a first flap attachment component 730, shown in FIG. 5, configured on an inside surface of the first flap, to the first inner extension attachment component 76, also shown in FIG. 5. Likewise, the second flap 74" is detachably attached by a second flap attachment component 740, shown in FIG. 5, to the second inner extension attachment component 78 also shown in FIG. 5. The first flap attachment component may be detachably attached to an outer extension attachment component, such as an outer extension second attachment component 63, shown in FIG. 5. The first outer extension 62 of the first expansion portion 60 may also have an outer extension first attachment component 61 configured for detachable attachment to a folded portion attachment component 66, shown in FIG. 4. Likewise, the second outer extension 82 of the second expansion portion 80 may also have an outer extension first attachment component 81 configured for detachable attachment to a folded portion attachment component 86 shown in FIG. 4.

The configuration of attachment components described herein, enables a flap to be attached to the inner extension attachment component and also the fold portion attachment component attached to an outer extension attachment component to very securely retain the expansion portion in a stowed and folded configuration with two points of retention or attachment. The flap may then be detached from the inner extension attachment component and the fold portion can be detached from the outer extension attachment component to enable the expansion portion to unfold and expand with the section coupler configured in a detached configuration with the first coupler component 56 detached from the second coupler component 58. Also, the flap may be attached to the interior surface of the outer extension with the flap attachment component detachably attached to the outer extension attachment component. This will hold the flap out of the way for the expansion portion to expand.

As shown in FIG. 5, the second expansion portion 80 has the second flap 74 detachably attached via the second flap attachment component 740 attached to the outer extension second attachment component 83 or the second outer extension 82 of the second expansion portion 80. The first flap attachment component 730 is shown in FIG. 5 as the first flap 73 is folded away to allow the first expansion portion 60 to unfold to an expanded configuration. The flap extending over the inlet end 22 of the expansion sections or expansion portions of an expansion section prevents water from flowing between the folds or layers of the expansion portion when in a stowed configuration and this reduces stress on the expansion portion and more effectively keeps the expansion portions stowed during use.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An expandable drift sock system comprising:

a) cylindrical sleeve comprising:

i) an inlet end forming an inlet opening;

ii) an outlet end forming an outlet opening; and iii) plurality of expansion sections, each comprising;

an inner extension comprising:

a first inner extension attachment component;

a second inner extension attachment component;

a first expansion portion comprising:

a first outer extension;

a first fold portion that extends from the first outer extension to a first fold edge of the inner extension; and a first coupler component extending between the first outer extension and the first fold portion;

a second expansion portion;

a second outer extension having an outer extension first attachment component on an inside surface of the second outer extension;

a second fold portion that extends from the second outer extension to a second fold edge of the inner extension; and a second coupler component extending between the second outer extension and the second fold portion;

a first flap coupled to the first expansion portion and having a first flap attachment component configured to detachably attach to the first inner extension attachment component when the first expansion portion is in a packed configuration; and a second flap coupled to the second expansion portion having a second flap attachment component configured to detachably attach to the second inner extension attachment component when the second expansion portion is in a packed configuration; and a coupler interface configured to detachably attach said first expansion portion to said second expansion portion.

2. The expandable drift sock system of claim 1, comprising three expansion sections.

3. The expandable drift sock system of claim 1, comprising four expansion sections.

4. The expandable drift sock system of claim 3, wherein the first fold portion further comprises a folded portion attachment component;

wherein the second fold portion further comprises a folded portion attachment component;

wherein the outer extension first attachment component of the first outer extension is configured to detachably attach to the folded portion attachment component of the first folded portion when the first expansion portion is in a stowed configuration; and wherein the outer extension first attachment component of the second outer extension is configured to detachably attach to the folded portion attachment component of the second folded portion when the second expansion portion is in a stowed configuration.

5. The expandable drift sock system of claim 4, wherein the outer extension first attachment component of the first outer extension is configured to detachably attach to the first flap attachment component of the first flap when the first expansion portion is in an expanded configuration; and wherein the outer extension second attachment component of the second outer extension is configured to detachably attach to the second flap attachment component of the second flap when the second expansion portion is in an expanded configuration.

6. The expandable drift sock system of claim 1, wherein each of the first and second outer extensions further comprise, on said inside surface, an outer extension first attachment component and an outer extension second attachment component.

7. The expandable drift sock system of claim 6, wherein the first fold portion further comprises a folded portion attachment component;

wherein the second fold portion further comprises a folded portion attachment component;

wherein the outer extension first attachment component of the first outer extension is configured to detachably attach to the first flap attachment component when the first expansion portion is in an expanded configuration; and wherein the outer extension first attachment component of the second outer extension is configured to detachably attach to the second flap attachment component when the second expansion portion is in an expanded configuration, wherein the outer extension second attachment component of the first outer extension is configured to detachably attach to the folded portion attachment component of the first folded portion when the first expansion portion is in a stowed configuration; and wherein the outer extension first attachment component of the second outer extension is configured to detachably attach to the folded portion attachment component of the second folded portion when the second expansion portion is in a stowed configuration.

8. The expandable drift sock system of claim 1, wherein each of the first and second outer extensions further comprise, on said inside surface, an outer extension attachment component wherein the outer extension attachment component of the first outer extension is configured to detachably attach to the first flap attachment component of the first flap when the first expansion portion is in an expanded configuration; and wherein the outer extension first attachment component of the second outer extension is configured to detachably attach to the second flap attachment component of the second flap when the second expansion portion is in an expanded configuration.

9. The expandable drift sock system of claim 1, wherein the inner extension extends from a first fold edge extending between the inner extension and the first fold portion to a second fold edge extending between the inner extension and the second fold portion.

10. The expandable drift sock system of claim 9, wherein the first fold edge and second fold edge extend from the inlet end toward the outlet end of the cylindrical sleeve.

11. The expandable drift sock system of claim 1, wherein the drift sock has an inlet opening diameter with each of the plurality of expansion sections in a stowed configuration of at least 25 cm.

12. The expandable drift sock system of claim 1, wherein an expanded inlet diameter of the inlet end when each of the plurality of expansion sections are in an expanded configuration is at least two times larger than a stowed inlet diameter of the inlet end when the plurality of expansion sections are in a stowed configuration.

13. The expandable drift sock system of claim 12, comprising four or more expansion sections.

14. The expandable drift sock system of claim 13, wherein a length of the cylindrical sleeve form the inlet end the outlet end is at least 0.5 m.

15. The expandable drift sock system of claim 1, wherein coupler interface is a zipper.

16. The expandable drift sock system of claim 15, wherein each of the first expansion portion comprises a first extension fold between the first outer extension and the first fold portion and wherein the second expansion portion comprises a second extension fold edge between the second outer extension and the second fold portion, and wherein the zipper is coupled to the first and second extension fold edges.

17. An expandable drift sock system comprising:

a) cylindrical sleeve comprising:

i) an inlet end forming an inlet opening;

ii) an outlet end forming an outlet opening;

iii) four expansion sections, each comprising;

an inner extension comprising:

a first inner extension attachment component;

a second inner extension attachment component;

a first expansion portion comprising:

a first outer extension;

a first fold portion that extends from the first outer extension to a first fold edge of the inner extension;

a first coupler component extending between the first outer extension and the first fold portion;

a second expansion portion;

a second outer extension having an outer extension first attachment component on an inside surface of the second outer extension;

a second fold portion that extends from the second outer extension to a second fold edge of the inner extension;

a second coupler component extending between the second outer extension and the second fold portion;

a first flap coupled to the first expansion portion and having a first flap attachment component configured to detachably attach to the first inner extension attachment component when the first expansion portion is in a packed configuration; and a second flap coupled to the second expansion portion having a second flap attachment component configured to detachably attach to the second inner extension attachment component when the second expansion portion is in a packed configuration;

a coupler interface configured to detachably attach said first expansion portion to said second expansion portion; and wherein the first fold portion and the second fold portion each comprise a fold portion attachment component configured to detachably attach to the first attachment component of the outer extension;

wherein the first fold portion further comprises a folded portion attachment component and wherein the second fold portion further comprises a folded portion attachment component;

wherein each of the first and second outer extensions further comprise, on said inside surface, an outer extension first attachment component;

wherein the outer extension first attachment component of the first outer extension is configured to detachably attach to the folded portion attachment component of the first folded portion when the first expansion portion is in a stowed configuration; and wherein the outer extension first attachment component of the second outer extension is configured to detachably attach to the folded portion attachment component of the second folded portion when the second expansion portion is in a stowed configuration;

wherein the outer extension first attachment component of the first outer extension is configured to detachably attach to the first flap attachment component when the first expansion portion is in an expanded configuration; and wherein the outer extension second attachment component of the first outer extension is configured to detachably attach to the second flap attachment component when the second expansion portion is in an expanded configuration;

wherein each of the first and second outer extensions further comprise, on said inside surface, an outer extension first attachment component;

wherein the outer extension first attachment component of the first outer extension is configured to detachably attach to the first flap attachment component when the first expansion portion is in an expanded configuration; and wherein the outer extension second attachment component of the first outer extension is configured to detachably attach to the second flap attachment component when the second expansion portion is in an expanded configuration;

wherein the inner extension extends from a first fold edge extending between the inner extension and the first fold portion to a second fold edge extending between the inner extension and the second fold portion;

wherein the first fold edge and second fold edge extend from the inlet end toward the outlet end of the cylindrical sleeve; and wherein the drift sock has an inlet opening diameter with each of the plurality of expansion sections in a stowed configuration of at least 25 cm.

18. The expandable drift sock system of claim 17, wherein an expanded inlet diameter of the inlet end when each of the plurality of expansion sections are in an expanded configuration is at least two times larger than a stowed inlet diameter of the inlet end when the plurality of expansion sections are in a stowed configuration; and wherein a length of the cylindrical sleeve form the inlet end the outlet end is at least 0.5 m.

19. The expandable drift sock system of claim 18, wherein an expanded inlet diameter of the inlet end when each of the plurality of expansion sections are in an expanded configuration is at least two times larger than a stowed inlet diameter of the inlet end when the plurality of expansion sections are in a stowed configuration.

* * * * *